United States Patent [19]

Melin et al.

[11] Patent Number: 4,752,411

[45] Date of Patent: Jun. 21, 1988

[54] LIQUID COMPOSITION FOR CLEANING HARD SURFACES

[75] Inventors: Christiane Melin, Courbevoie; Nicole Peton, Ivry sur Seine, both of France

[73] Assignee: Cotelle, S.A., France

[21] Appl. No.: 738,691

[22] Filed: May 28, 1985

[30] Foreign Application Priority Data

May 28, 1984 [FR] France ..... 84 08318

[51] Int. Cl.[4] ..... C11D 1/34

[52] U.S. Cl. ..... 252/174.16; 252/135; 252/156; 252/527; 252/540; 252/546; 252/DIG. 14; 252/DIG. 16; 134/29; 134/38; 134/39

[58] Field of Search ..... 252/156, 174.16, 527, 252/540, 135, 546, DIG. 14, DIG. 17; 134/29, 38, 39

[56] References Cited

U.S. PATENT DOCUMENTS

| | | | |
|---|---|---|---|
| 3,624,006 | 11/1971 | Karg | 252/174.16 |
| 3,738,943 | 6/1973 | Kaneko | 252/DIG. 17 |
| 3,898,186 | 8/1975 | Mermelstein et al. | 252/DIG. 14 |
| 3,898,187 | 8/1975 | Miller | 252/DIG. 14 |
| 3,951,826 | 4/1976 | Rasmussen | 252/174.16 |
| 3,963,649 | 6/1976 | Spadini et al. | 252/DIG. 14 |
| 4,070,309 | 1/1978 | Jacoben | 252/DIG. 17 |
| 4,140,647 | 2/1979 | Mizutani et al. | 252/174.16 |

*Primary Examiner*—A. Lionel Clingman
*Assistant Examiner*—Hoa Van Le
*Attorney, Agent, or Firm*—Brumbaugh, Graves, Donohue & Raymond

[57] ABSTRACT

Alkaline liquid detergent composition comprising anionic surface active agents, and among them at least one soap and at least one phosphoric ester, non-ionic surface active agents, detergency builders, sequestering agents, optionally perfumes and/or dyes and/or other compatible additives, and water as a complement. Application to the cleaning of all washable hard surfaces.

10 Claims, No Drawings

LIQUID COMPOSITION FOR CLEANING HARD SURFACES

BACKGROUND OF THE INVENTION

1. Field of the Invention

The present invention concerns a composition for cleaning hard surfaces. It concerns more particularly a cleaning composition for hard surfaces appearing in the form of a concentrated liquid usable as is or in a diluted form incorporating water as a complement. Advantageously the compound is a stable, clear solution in a single phase.

2. Description of the Prior Art

One traditionally distinguishes three categories of cleaning products for hard surfaces, namely: Scouring powders, creams with fine abrasives, liquids.

The composition according to the invention belongs to this third category. It comprises phosphoric esters.

Numerous liquid compositions for cleaning hard surfaces have already been described These compositions have for the most part a relatively low content in active components (on average 15–20% by weight of active components based on the weight of the composition) and comprise a high proportion of water.

Documents DE-2.603.307 and FR-2.396.797 describe cleaning compositions comprising phosphoric esters; it is pointed out that these compositions must be acid in order to give, on drying, a good surface brightness on the articles cleaned.

In documents FR-2.027.559 and FR-2.394.602 are described phosphoric esters, presented as useful for the solubilization and respectively the dispersion of insoluble hydrocarbons in an aqueous medium.

A single phase liquid detergent containing among other phosphoric esters is described in document FR-2.193.871. However it is mentioned therein that the detergent composition must comprise a major proportion of water and that the phosphoric esters suggested function is to favor the softening of materials, as it is pointed out that the detergent compositions which contain them are essentially destined to the washing of linen with a softening effect.

Detergent compositions with phosphoric esters for cleaning household utensils or solid surfaces are also described in documents FR-2.359.893 and EP-94.119. However the phosphoric esters are only additives of detergent reinforcing agents in these compositions: presented for this purpose among other possible compounds, they are not selected for preference. Moreover, the detergent compositions do not comprise non-ionic surface active agents, but comprise amine oxides among the essential components.

On the other hand, document DE-2.008.777 describes a composition of surface active agents allowing properties of regulated foaming to be obtained, which is a determining criterion for use in a machine.

In this composition, phosphoric esters are associated with non-ionic surface active agents to ensure together a function of foam inhibition, and these compounds are combined with a foaming anionic surface active agent, so that the overall compound is a foaming compound with regulated foam height. The anionic surface active agent comprises compulsorily a sulphate or a sulphonate. The phosphoric esters, which are more precisely alkylether phosphates, have a low number (that is less than 2 according to the examples) of alkylene oxide groups and a chain length of the esterifying alkyl group as great as possible (that is at least in $C_{18}$, according to the examples illustrating these requirements).

Considerations of the same type, applied to composition for washing products which is a low foaming powder, are developed in document FR-2.318.921.

Despite these proposals, albeit somewhat contradictory, there exists a need for detergent compositions capable of cleaning hard surfaces and of removing all types of stains and particulate spots, without scratching, and in a liquid form, preferably in a single phase.

SUMMARY OF THE INVENTION

It has been found that this aim can be reached, as well as others which will appear from the description hereunder, by means of a composition associating phosphoric esters and an appropriate combination of other components with a detergent or detergent reinforcing action, as an active material, in an aqueous medium.

Thus one object of the invention is an alkaline liquid composition having in a single, stable phase for cleaning hard surfaces, characterized in that it comprises:

(a) at least two anionic surface active agents, and among them at least one soap and at least one phosphoric ester,
(b) at least one non-ionic surface active agent,
(c) at least one detergency builder
(d) at least one sequestering agent,
(e) water, to make %100, and
(f) optionally perfumes and/or coloring agents and/or other compatible additives.

DETAILED DESCRIPTION OF THE EMBODIMENT

In what follows the percentages which will be indicated are by weight in relation to the total weight of the composition, except if stated otherwise.

According to a preferred embodiment, the composition according to the invention is a concentrate comprising about 30% to 60%, preferably from 40% to 50%, of active material. The term active material refers to the sum of the surface active agents, detergency builders and the sequestering agents.

Moreover, advantageously, the composition comprises approximately:

(a) 15%–30%, preferably 18%–25% and even more preferably about 20% of anionic surface active, agents,
(b) 2%–10%, preferably 4%–8% of non-ionic surface active agents,
(c) 5%–15%, preferably 8%–12% of detergency builders,
(d) 3%–10%, preferably 3%–8% of sequestering agents,
(e) water, sufficient to make %100, the sum of components (a), (b), (c) and (d) being %30–60% of the total composition, and
(f) the composition additionally contains, or may contain, perfumes and/or dyes and/or other compatible additives.

According to a preferred embodiment component (a) may comprise approximately:

4%–8% soaps

11%–26%, preferably about 16% phosphoric esters or a mixture of a phosphoric ester and of at least one other anionic surface active agent.

Advantageously the ratio by weight between the phosphoric ester and the non-ionic surface active agents is 1.5:1 to 4:1, preferably from 2:1 to 3:1. For example, for composition being 14% phosphoric ester, the proportion of non-ionic surface active agent is preferably comprised of between about 5% to 7%.

The ratio by weight between the phosphoric ester and the other non-soap anionic surface active agents is preferably from 1:1 to 20:1.

The composition constitutes advantageously a single stable phase. It is alkaline and under its preferred forms of implementation it presents a pH of about 10-11.

The individual components of the present cleaning compositions are described in detail hereunder.

Anionic surface active agent

The anionic detergents which are used according to the invention comprise at least one soap and at least one phosphoric ester.

Among the soaps that may be used here are the sodium salts, potassium or alkanolamine salts of higher fatty acids, containing preferably from 12 to 20 carbon atoms, originating from vegetable or animal esters, for example palm oil, coconut oil, tallow or mixtures thereof. Potassium salts of a mixture of fatty acids in $C_{12}$to $C_{18}$ are preferred.

Among the phosphoric esters which may be used according to this invention, one should quote especially the oxyalkylenated phosphoric esters, also called phosphated alkyl ethers, in which the alkyl chain of the esterifying group comprises between 8 and 12 carbon atoms and in which the oxyalkylenated or ether group comprises from 2 to 18 oxyalkylene groups, preferably oxyethylene and/or oxypropylene, in the form of their sodium, potassium or alkanolamine (mainly mono-, di- or tri-ethanolamine) salts.

In the present context it is understood by phosphoric ester, the mono-ester as well as the di-ester or even, which is the preferred case for it corresponds to the formula of commercial phosphoric esters, a mixture of both.

These phosphoric esters are obtained, in a known manner, by a condensation reaction between the oxyalkylated alcohols $R(OC_x,H_{2x})_yOH$ and a phosphoric or polyphosphoric acid, R being a $C_8$–$C_{12}$ alkyl group, while x is equal to 2 or 3 and y is a number from 2 to 18.

One may represent them by the formulae:

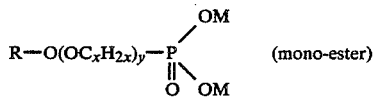

(mono-ester)

and

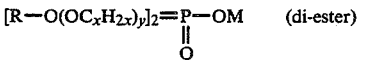

(di-ester)

where R, x and y are such as defined above, and where M is hydrogen, an alkaline cation such as for instance sodium or potassium, or the residue of an alkanolamine.

Among the other anionic detergents capable of being present also, if desired, in the compound according to the invention. one may quote the alkylbenzene sulphonates having from 10 to 18 carbon atoms in the alkyl group, the paraffin sulphonates having from 10 to 18 carbon atoms, the alpha-olefin sulphonates having from 10 to 18 carbon atoms, and the alkyl ether sulphates, the alkyl group of which possesses from 10 to 16 carbon atoms and the ether group of which comprises between 2 and 6 groups of alkylene oxide, preferably ethylene oxide. Among these additional compounds the alpha-olefin sulphonates are preferred.

Among the non-ionic surface active agents which may be used according to the invention, one should quote more particularly the oxyalkylenated fatty alcohols and the oxyalkylenated alkylphenols, the alkyl chain of which comprises from 8 to 18 carbon atoms and comprising from 4 to 18 alkylene oxide groups, preferably ethylene oxide or propylene oxide.

Detergency builders

These compounds correspond to the detergency builders or detergency reinforcing agents known to those of ordinary skill in the art.

They may be preferably alkaline electrolytic salts, such as sodium or potassium carbonates. Sequestering agents Among the sequestering agents known to those of ordinary skill in the art, which may be used according to the invention, one should quote more particularly:

The sodium or potassium polyphosphates (pyro-or tripolyphosphates), the polycarboxylates such as ethylene diamine tetraacetate, nitrilotriacetate and citrate of potassium or sodium, diethylene triamine, pentamethylene phosphonate of sodium or potassium.

The composition according to this invention may also comprise, if one so wishes, other non-essential constituents, such as perfumes and/or dyes and/or other compatible additives, destined to improve the properties or the aesthetic aspect of the compositions.

One can formulate the cleaning composition for hard surfaces according to the invention by preparing separately, if necessary, each of its components and then mixing them intimately, jointly with the water which constitutes the solvent medium. This preparation can be made by means of techniques known to those of ordinary skill in the art.

In concentrates, in particular containing 30%–60% active material, the water is preferably deionized or demineralized.

According to another embodiment, the concentrated composition such as mentioned above may be diluted, either during its manufacture, or before use, and kept in diluted form. In this case the water of dilution may be, partly or wholly, tap water.

The composition obtained in its concentrated form as well as in its diluted form, and in particular that which comprises the preferred components indicated above in relation to the concentrated formula, is stable in storage, advantageously in a clear single phase.

It has unexpectedly been found that the composition in its concentrated form may be diluted easily, in particular before being used or before beinq stored by the final user, for example according to a dilution bringing up the volume approximately 1 to 4, simply by the addition to the initial volume of the concentrated composition of the appropriate volume of tap water, whatever the temperature and the hardness of the latter is, and that a limpid and stable diluted liquid composition is obtained, without any flocculation, in particular with the components indicated above and with the respective proportions of the components indicated above in reference to the concentrated formula.

The diluted composition obtained also forms part of the present invention. It constitutes a product corresponding to household habits and to a concentration of active cleaning materials adequate for the cleaninq to be carried out, in particular for cleaning, either occasionally or routinely, hard floors, tiles, washable painted surfaces, working surfaces, sanitary devices, etc.

The primary advantage of the concentrated formulation over the diluted formulation is that, while allowing the final user to obtain the latter easily and to store it for ultimate use, the concentrate renders possible a clear decrease of the costs and of the requirements for demineralization of the mains water by the manufacturer and makes it possible to reduce considerably the weiqht and volume of the packaging, as well as the cost of storage and transport.

In use under normal conditions and according to the usual household habits, the compositions accordinq to this invention ensure the elimination of many stains, even very tenacious ones, from hard surfaces, slightly porous as well as non-porous, and dry up without a trace.

In compositions according to the invention, the soap brings an essential contribution to the detergent power on hard surfaces and, in combination with the phosphoric esters and the non-ionic surface active agents, it ensures the stability of the composition in a single and clear liquid phase.

The invention is illustrated in greater detail in the examples hereunder, which do not limit it in any way. In these examples, also the percentages are understood by weight of the 100% pure compound, in relation to the total weight of the composition. The abbreviations used, for example $C_{10}$–$C_{14}$, 5 EO are conventional and define on the one hand the number of carbon atoms of the alkyl groups and on the other hand the amounts of ethylene oxide groups in the molecules concerned.

EXAMPLE 1

Nine compositions for cleaning hard surfaces have been prepared, the components and the proportion by weight of which are shown in Table I hereunder (compositions Nos. 1 to 9).

Composition No. 1 was prepared as follows: into 530 g of alkyl ether phosphate $C_8$, 6 EO at 30%, neutralized by triethanolamine and stirred with 110 g of deionized water, 7 g of potash were dissolved and neutralization was made with 35 g of fatty acid; 160 g of 50% potassium carbonate and 80 g of trisodium citrate dihydrate were added thereto. Stirring was continued until complete dissolution of the solid materials, then 80 g of oxyethylenated fatty alcohol, $C_{12}$–$C_{14}$, 7 EO was added and stirring was continued for about 15 to 30 minutes.

Compositions Nos. 2 to 9, were prepared in the same manner, replacing each time the above-mentioned phosphoric ester by that which is shown in Table I in each case.

The comparison of these compositions shows clearly the influence of the length of the alkyl chain of the alkyl ether phosphates on the characteristics of the corresponding compositions; thus:

Composition No. 1 formed a single, clear phase; it had a clouding point of 92° C. and a viscosity of 62 mPa.s. The dilution of this composition up to 4 times its initial volume gave a slight precipitate if it was made with tap water, and a single phase solution still perfectly clear when it was made with deionized water.

Compositions Nos. 2, 3, 4, 6, 7 and 9 gave two phases; composition No. 7 moreover gave rise to a sliqht precipitation of a solid.

Composition No. 5 formed a single, clear phase; it had a clouding point of 58° C. and a viscosity of 326 mPa.s. The dilution of this composition up to 4 times its initial volume gave a slight precipitate if it was made with tap water, and a solution in a single phase still perfectly clear when it was made with deionized water.

Composition No. 8 formed a single phase, with a slight cloud, and had a clouding point of 30° C.

TABLE I

| CONSTITUENTS | COMPOSITION NO. 1 | 2 | 3 | 4 | 5 | 6 | 7 | 8 | 9 |
|---|---|---|---|---|---|---|---|---|---|
| Alkyl ether phosphate $C_8$, 6 EO | 16% | | | | | | | | |
| Alkyl ether phosphate $C_{13}$, 6 EO | | 16% | | | | | | | |
| Nonylphenol ether phosphate, 6 EO | | | 16% | | | | | | |
| Nonylphenol ether phosphate, 10 EO | | | | 16% | | | | | |
| Alkyl ether phosphate $C_{10}$–$C_{12}$, 5 EO | | | | | 16% | | | | |
| Alkyl ether phosphate $C_{14}$–$C_{14}$, 7 to 8 EO | | | | | | 16% | | | |
| Alkyl ether phosphate $C_{16}$–$C_{18}$, 4 EO | | | | | | | 16% | | |
| Alkyl ether phosphate $C_8$, 6 EO | | | | | | | | 16% | |
| Alkyl ether phosphate $C_{10}$–$C_{12}$, 6 EO | | | | | | | | | 16% |
| Oxyethylated fatty alcohol $C_{12}$–$C_{14}$, 7 EO | 8% | 8% | 8% | 8% | 8% | 8% | 8% | 8% | 8% |
| Potassium soap of $C_{16}$–$C_{18}$ fatty acids | 4% | 4% | 4% | 4% | 4% | 4% | 4% | 4% | 4% |
| Potassium carbonate | 8% | 8% | 8% | 8% | 8% | 8% | 8% | 8% | 8% |
| Dihydrated trisodium citrate | 8% | 8% | 8% | 8% | 8% | 8% | 8% | 8% | 8% |
| Demineralized water, sufficient to make | 100% | 100% | 100% | 100% | 100% | 100% | 100% | 100% | 100% |

EXAMPLE 2

Five other compositions for cleaning hard surfaces in accordance with this invention were prepared. These had the respective components and the proportions by weight shown in Table II hereunder (compositions Nos. 10 to 14).

Composition No. 10 was prepared as follows: into 466 g of alkyl ether phosphate $C_8$, 6 EO at 30%, neutralized with triethanolamine and stirred with 12 g of deionized water, 52 g of sodium alpha-olefin sulphonate at 38.5% were added. Once the agitated medium became limpid, 7 g of potash were dissolved therein and neutralization was made with 35 g of fatty acid; 160 g of potassium carbonate at 50% and 19 g of EDTA at 37.5% were then added. Stirring was continued until the solid materials were dissolved, then 80 g of oxyethylenated fatty alcohol $C_{12}$–$C_{14}$.7 EO were added, and stirring was continued for about 15 to 30 minutes.

Compositions Nos. 11 to 14, were prepared in the same manner, while varying the proportions of the constituents as shown in Table II.

Table II also indicates the physical state, the clouding point and the viscosity of the compositions, as well as the physical state of the compositions after dilution of the concentrated composition concerned up to 4 times its initial volume with tap water.

The comparison of these compositions shows the influence of the ratio alkyl ether phosphate/sulphonate on the physical stability.

TABLE II

| CONSTITUENTS | COMPOSITION NO. 10 | 11 | 12 | 13 | 14 |
|---|---|---|---|---|---|
| Alkyl ether phosphate $C_8$, 6 EO | 9% | 10% | 12% | 14% | 16% |
| Alpha-olefin sulphonate, $C_{14}$–$C_{16}$ | 7% | 6% | 4% | 2% | 0% |
| Oxyethylenated fatty alcohol $C_{12}$–$C_{14}$, 7 EO | 8% | 8% | 8% | 8% | 8% |
| Potassium soap of $C_{16}$–$C_{18}$ fatty acids | 4% | 4% | 4% | 4% | 4% |
| Potassium carbonate | 8% | 8% | 8% | 8% | 8% |
| EDTA | 7.2% | 7.2% | 7.2% | 7.2% | 7.2% |
| Demineralized water, sufficent to make | 100% | 100% | 100% | 100% | 100% |
| Physical state | 1 phase cloudy | 1 phase clear | 1 phase clear | 1 phase clear | 1 phase clear |
| Clouding point, °C. | 24 | 42 | 54 | 67 | 57 |
| Viscosity, mPa.s | 100 | 106 | 92 | 74 | 62 |
| Physical state after dilution 4 times initial volume | — | 1 phase clear | 1 phase clear | 1 phase clear | 1 phase clear |

EXAMPLE 3

By operating as for composition No. 5 of Example 1, but by replacing the citrate by an equivalent quantity of sodium nitrilotriacetate, a composition (No. 15) was obtained in accordance with the invention having the characteristics shown hereunder.

| | Composition No. 15 |
|---|---|
| Alkyl ether phosphate $C_{10}$–$C_{12}$, 5 EO | 16% |
| Oxyethylenated fatty alcohol $C_{12}$–$C_{14}$, 7 EO | 8% |
| Potassium soap of fatty acids in $C_{16}$–$C_{18}$ | 4% |
| Potassium carbonate | 8% |
| Sodium nitrilotriacetate | 8% |
| Demineralized water, up to | 100 |
| physical state | 1 clear phase |
| clouding point, °C. | 50 |
| Viscosity, mPa.s | 260 |

Physical state after dilution to 4 times initial volume: 1 clear, phase

The diluted clear formulation of the above examples were tested for brightness on brilliant and colored ceramics and for the removal of stains (fats, street dust and lamp black) on plastic surfaces and mat ceramics.

The results obtained make it possible to consider that the compositions tested are at least equivalent to commercial products at present on the market for cleaning hard surfaces, as regards brilliance as well as for detergency.

We claim:

1. An alkaline liquid composition for cleaning hard surfaces, said composition consisting essentially of
   (a) at least two anionic surface active agents, including 4 to 8% of at least one soap and 11 to 26% of at least one phosphoric ester of an oxyalkylenated alcohol, in which the alkyl chain of the alcohol group contains between 8 and 12 carbon atoms and the oxyalkylene group contains from 2 to 18 oxyalkylenated groups, with the proviso that the composition contains from 15 to 30% anionic surface active agents;
   (b) at least one non-ionic surface active agent, the ratio by weight of the phosphoric ester to the non-ionic surface active agent being from 1.5:1 to 4:1;
   (c) at least one detergency builder;
   (d) at least one sequestering agent; and
   (e) water.

2. A liquid composition according to claim 1, wherein the anionic surface active agent consists of
   at least one soap;
   at least one phosphate ester; and
   one or more compounds selected from the group consisting of alkylbenzene sulfonates, paraffin sulfonates, alpha-olefin sulfonates and alkyl ether sulfates.

3. A composition according to claim 1 which also includes at least one perfume or dye.

4. A composition according to claim 1 or 2, wherein said composition is in a concentrated form and wherein the constituents (a) to (d) represent about 30% to 60% of the total weight of the composition.

5. A composition according to claim 4, wherein the weight proportion of (c) is 5%–15%, and of (d) is 3%–10%, based on the total weight of composition.

6. A composition according to claim 1, wherein component (a) includes at least one additional anionic surface active agent selected from the group consisting of alkylbenzene sulfonates, paraffin sulfonates, alpha-olefin sulfonates and alkyl ether sulfates, and the weight ratio of phosphoric ester to said additional surface active agents is from 1:1 to 20:1.

7. A composition according to claim 1 wherein said composition is in diluted form and comprises tap water for part or the whole of the water used as the complement.

8. A composition according to claim 1, wherein said composition is in the form of a liquid in a single phase.

9. A composition according to claim 7, wherein said composition is diluted from 1 to about 4, with tap water.

10. A method for cleaning hard surfaces which is characterized by using a liquid composition according to claim 1, comprising dilution of the said composition, before use or before storage by the final user with an appropriate amount of tap water.

* * * * *

UNITED STATES PATENT AND TRADEMARK OFFICE

CERTIFICATE OF CORRECTION

PATENT NO. : 4,752,411

DATED : June 21, 1988

INVENTOR(S) : Melin, et al.

It is certified that error appears in the above-identified patent and that said Letters Patent is hereby corrected as shown below:

Col. 3, line 13, "agent" should read --agents--;

Col. 3, line 24, "$C_{12}$to" should read --$C_{12}$ to--;

Col. 4, line 16-17, "Sequestering agents" should appear on a separate line, as a heading;

Col. 6, TABLE I, 10th line under "CONSTITUENTS", "Oxyethylated" should read --Oxyethylenated--;

Col. 8, line 36, "claim 1 or 2" should read --claim 1 or 3--.

Signed and Sealed this

Nineteenth Day of September, 1989

*Attest:*

*Attesting Officer*

DONALD J. QUIGG

*Commissioner of Patents and Trademarks*